US005695160A

United States Patent [19]

Cockrum

[11] Patent Number: 5,695,160

[45] Date of Patent: Dec. 9, 1997

[54] DECORATIVE TISSUE BOX HOLDER

[76] Inventor: Steven A. Cockrum, 815 Versailles St., Mesquite, Tex. 75149

[21] Appl. No.: 571,561

[22] Filed: Dec. 13, 1995

[51] Int. Cl.[6] ..... A47G 23/02

[52] U.S. Cl. ..... 248/146; D6/518; 206/233; 248/905

[58] Field of Search ..... 248/905, 146, 248/346.01, 519, 121, 309.1, 310, 314; 206/233; D6/518

[56] References Cited

U.S. PATENT DOCUMENTS

| | | | |
|---|---|---|---|
| D. 278,295 | 4/1985 | Thompson et al. | D6/518 |
| D. 340,373 | 10/1993 | Konklin | D6/518 |
| D. 352,412 | 11/1994 | Lopez | D6/518 |
| D. 353,996 | 1/1995 | Boysen | D9/322 |
| 2,580,982 | 1/1952 | Weiss | 312/50 |
| 2,841,275 | 7/1958 | Schwimmer et al. | 206/57 |
| 3,307,687 | 3/1967 | Steinman | 206/47 |
| 3,333,686 | 8/1967 | Schnabel | 206/47 |
| 4,513,862 | 4/1985 | Mallow | 206/233 |
| 4,524,871 | 6/1985 | Klinger | 206/233 |
| 4,879,442 | 11/1989 | Giovine | 206/233 |
| 5,404,800 | 4/1995 | Hsu | 248/146 X |

*Primary Examiner*—Ramon O. Ramirez
*Attorney, Agent, or Firm*—Smith & Catlett, P.C.

[57] ABSTRACT

An apparatus for holding a box of tissues, foliage, or other items is provided having two receptacles. The apparatus may be used as a base or form for craft projects such as a hand decorated tissue box cover or flower pot holder.

The holder apparatus includes an exterior receptacle surrounding an interior receptacle. The interior receptacle has adjacent sides substantially perpendicular to a central base. The exterior receptacle extends around the outer perimeter of the interior receptacle and has a base in a horizontal plane below the base of the interior receptacle. The side walls of the exterior receptacle curve outward radially away from the side walls of the interior receptacle.

7 Claims, 4 Drawing Sheets

DECORATIVE TISSUE BOX HOLDER

CROSS-REFERENCE TO RELATED APPLICATIONS

This application relates to co-pending Application Ser. No. 29/047,272, filed on Nov. 30, 1995, entitled "Cubic Tissue Box Cover" and co-pending application Ser. No. 29/047,273, filed on Nov. 30, 1995, entitled "Rectangular Tissue Box Cover."

BACKGROUND OF THE INVENTION

1. Field of the Invention

This invention relates to tissue box holders, and, more particularly, to a container for receiving and displaying decorative handcrafted items such as real or artificial foliage arrangements.

2. Description of the Related Art Including Information Disclosed under 37 CFR 1.97 and 1.98

Decorative tissue box holders and receptacles are well known. These items are commonly used to cover or improve the aesthetic appearance of standard tissue boxes placed in visible, accessible locations in homes, offices, public restrooms, and other similar sites. There is not, however, a product in the marketplace which can be easily used by individuals to create or handcraft a decorative holder to meet individual tastes or to match a specialized decor.

Although there are no known prior art teachings of such a handicraft or commercial product disclosed herein, a number of prior art references exist that discuss subject matter that bears some relation to the invention disclosed herein. Such prior art references are U.S. Pat. No. Des. 278,295; Des. 352,412; Des. 353,996; 2,580,982; 2,841,275; 3,307,687; 3,333,686; 4,513,862; 4,525,871; and 4,879,442. Each of these references is discussed briefly below.

U.S. Pat. No. Des. 278,295 to Thompson discloses the ornamental design for a tissue box holder comprising a top and a bottom section which define a rectangular parallelepiped exterior when assembled around the tissue box. U.S. Pat. Nos. Des. 352,412 to Lopez and U.S. Pat. No. Des. 353,996 to Boysen disclose the ornamental designs for a day bed and a house tissue box cover, respectively.

U.S. Patent No. 2,580,982 to Weiss discloses an integrated tissue sheet dispenser comprising a rectangular container having an upper wall with a passage for dispensing tissues individually. U.S. Pat. No. 2,841,275 to Schwimmer et al relates to a combination dispensing and disposal device having a top wall with an opening for removal of tissues and a base wall connected to folding side walls which define an expansible used tissue receptacle. Schwimmer '275 further discloses a bottom wall disposed above the base wall forming an enclosure for storing unused tissues separate from the used tissue receptacle.

U.S. Pat. No. 3,307,687 to Steinman discloses a tissue dispensing container having a waste receptacle and container for holding a cleaning liquid and water. U.S. Pat. No. 3,333,686 to Schnabel discloses a combination dual container for storing a stack of tissues and disposal bags. U.S. Pat. No. 4,513,862 to Mallow discloses a scented tissue-dispensing container having a sachet disposed within one wall of the container such that it is in contact with the stack of stored tissues. U.S. Pat. No. 4,525,871 to Klinger discloses a parallelepipedic container for holding disposable cloths and a cylindrical container such as a stick of lipstick. U.S. Pat. No. 4,879,442 to Giovine discloses a tissue container and waste tissue receptacle.

Review of each of the foregoing references reveals no disclosure or suggestion of a tissue box holder or container for personalized decoration such as that described and claimed herein.

SUMMARY OF THE INVENTION

An decorative apparatus for holding a box of tissues or other items is provided having an internal receptacle for placement of a removable item such as a tissue box or plant and an external receptacle for addition of decorative items such as real or artificial foliage. It is an object of the present invention to provide a holder which is a base or form for individualized decoration. It is another object of the present invention to provide a tissue box holder which is a base or form for handicraft decoration and display of said tissue box.

According to the present invention, the holder comprises an outer receptacle surrounding a central inner receptacle. In one aspect of the present invention, the inner receptacle comprises four adjacent sides substantially perpendicular to a central base and the outer receptacle comprises four adjacent sides substantially perpendicular to an outer base. In another aspect of the present invention, the base of the inner receptacle is in a horizontal plane above the base of the outer receptacle. In still another aspect of the present invention, the side walls of the outer receptacle curve outward radially away from the side walls of the inner receptacle.

In yet another aspect of the present invention, the interior width of the inner receptacle near the base is narrower than the interior width near the top. In another aspect of the present invention, the base width of the inner receptacle is slightly smaller than the top width of the inner receptacle to facilitate easy insertion, retention, and removal of the tissue box.

According to another embodiment of the present invention, the upper end of the side walls of the outer receptacle taper or flare away from the side walls of the inner receptacle such that the internal width of the outer receptacle is narrower at the base. In still another aspect of the present invention, the width of the outer base accommodates standard width craft foam for supporting craft items such as artificial foliage. In yet another aspect of the present invention, the outer base width of the outer receptacle is approximately one and fifteen-sixteenth inches wide ($1\frac{15}{16}$") to accommodate and secure craft foam having a two inch width when placed within the outer receptacle area.

According to another object of the present invention, the central receptacle is a holder for a tissue box and the outer receptacle retains the handcrafted decor. According to another object of the present invention, the central receptacle is a holder for live or artificial foliage.

According to one embodiment of the present invention, the holder is unitarily formed or injection molded of a standard moldable plastic such as styrene, having an overall holder surface thickness of approximately nine-one hundredths of an inch (0.09") throughout the apparatus.

In yet another aspect of the present invention, the dimensions of the inner receptacle's base are approximately ⅛ inches less that the length and width of the tissue box and the inner receptacle's top width is approximately ⅛ inches wider than the length and width of the tissue box to facilitate easy placement, retention and removal of the tissue box.

In another aspect of the present invention, the inner receptacle is a holder for a cubic tissue box wherein the box has a rectangular base size of approximately 4½ inches by 4¼ inches. In one embodiment of the present invention, the holder has interior base width dimensions of approximately 4⅜ inches by 4⅛ inches, an interior top width of approximately 4⅝ inches by 4⅜ inches, and four interior side walls approximately 5¼ inches in height.

In still another aspect of the present invention, the interior receptacle is a holder for a rectangular tissue box wherein the box has a rectangular base size of approximately 9⅜ inches by 4¾ inches. In one embodiment of the present invention, the holder has interior base width dimensions of approximately 9¼ inches by 4⅝ inches, and an interior top width of approximately 9½ inches by 4⅞ inches. In yet another aspect, the four interior side walls are approximately 3⅛ inches in height.

BRIEF DESCRIPTION OF THE DRAWINGS

The invention will be better understood and its numerous objects and advantages will become more apparent to those skilled in the art by reference to the following drawings, in conjunction with the accompanying specification, in which.

Like reference numerals are used to indicate like parts in all figures of the drawings.

DESCRIPTION OF THE PREFERRED EMBODIMENTS

Figure 1:
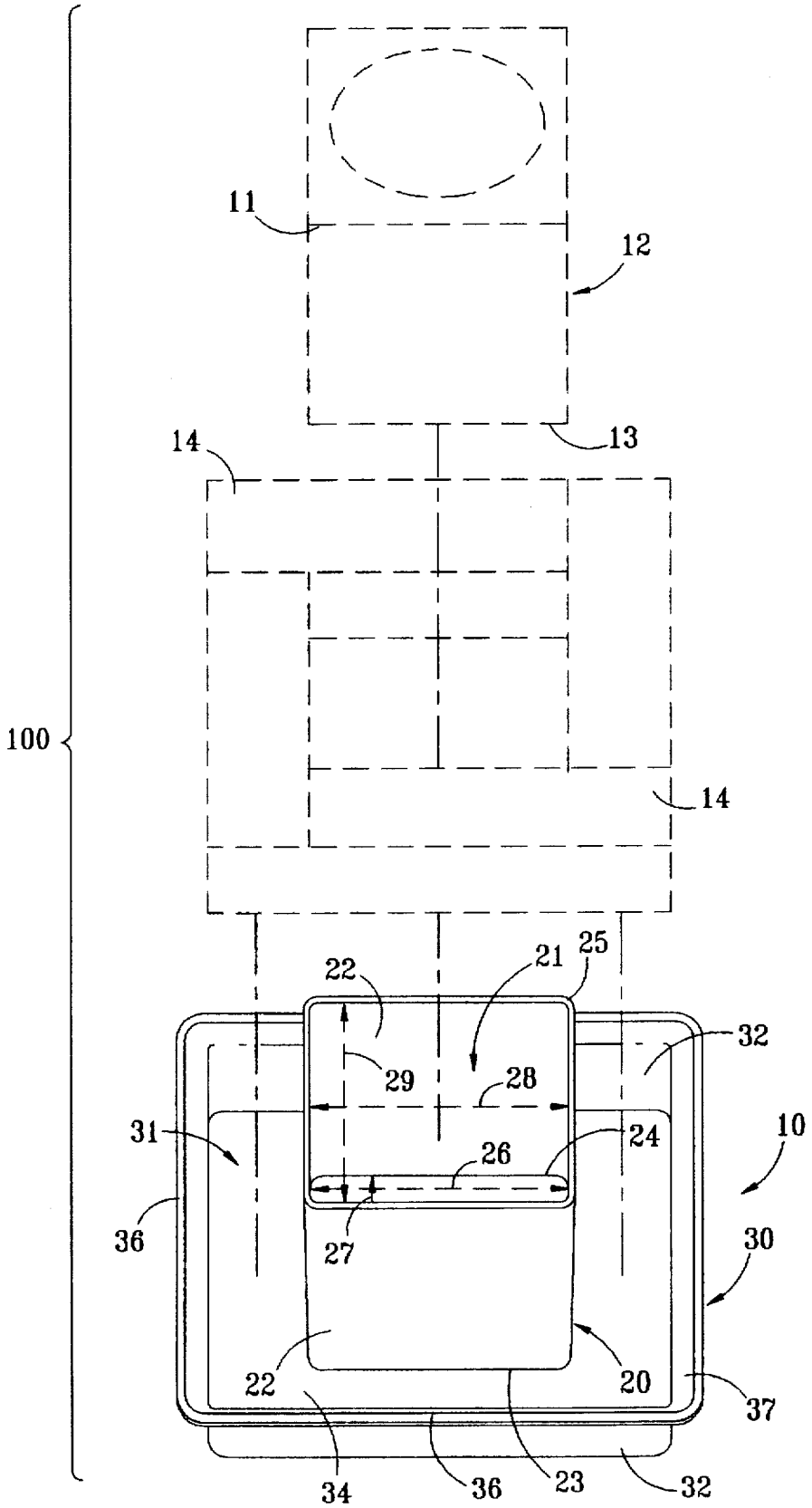
FIG. 1 is an exploded top perspective view of the holder apparatus of the present invention with a tissue box and supporting material shown in phantom.

A tissue box holder apparatus is provided which may be used alone or in combination with handicraft decorations such as real or artificial foliage, ribbons, fabric or the like. Referring to FIG. 1, an exploded perspective view of a preferred embodiment of holder assembly 100 is shown comprising holder 10 of the present invention, tissue box 12 and supporting material 14.

Holder 10 comprises a central inner receptacle 20 and a perimeter outer receptacle 30. As shown in FIGS. 1–4, central receptacle 20 includes an interior base 24, base perimeter 23, top 25, and side walls 22 defining central holding area 21. In a preferred embodiment, sides walls 22 are substantially perpendicular to interior base 24 such that the interior bottom width 26 of area 21 is approximately ¼ inch narrower than the interior top width 28. This configuration facilitates easy insertion, retention and removal of the tissue box 12 from central area 21.

Perimeter outer receptacle 30 has an exterior base 34 radially extending around the perimeter 23 of interior base 24 such that base perimeter 33 is adjacent to central instep section 38. Exterior base 34 is in a horizontal plane parallel to and lower than the horizontal plane of interior base 24. Central instep section 38 angles between bases 24 and 34 to form a single holder base 16 having a raised center 24.

Outer holding area 31 is defined by side walls 22, 32 and base 34. Side walls 32 are substantially perpendicular to base 34 and have a flared upper end 37 and rim 36. In one embodiment of the present invention, rim 36 is in a horizontal plane parallel to base 34. In a preferred embodiment, lower width 36 of holding area 31 is approximately 1/16 inch narrower than a standard width support material such as craft foam strip.

It will be understood and appreciated by those skilled in the art that holder 10 may be designed in a variety of shapes to accommodate placement of different articles in areas 21 and 31. For example, inner receptacle area 21 may be formed from a singular cylindrical side wall 22 to accommodate a standard flower pot. Alternatively, exterior receptacle area may have any geometric or free form shape defined by a continuous side wall 32 adjacent to base 34.

In a preferred embodiment of the present invention, holder 10 is unitarily formed of the material styrene and has an overall holder surface thickness 29 of approximately 0.09 inch. It will be understood and appreciated by those skilled in the art that holder 10 may be unitarily formed or injection molded of any formable material and that styrene is provided by way of example and not limitation. The actual holder surface thickness 29 will be determined by the strength of the material and the overall design of holder 10.

Figure 2:
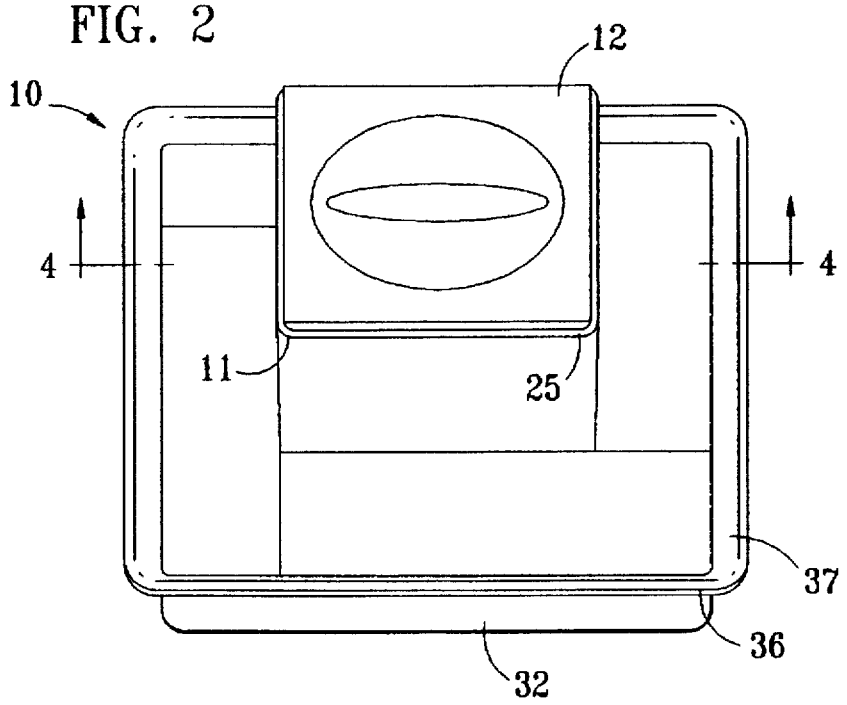
FIG. 2 is a top perspective view of the holder apparatus of the present invention.
Figure 3:
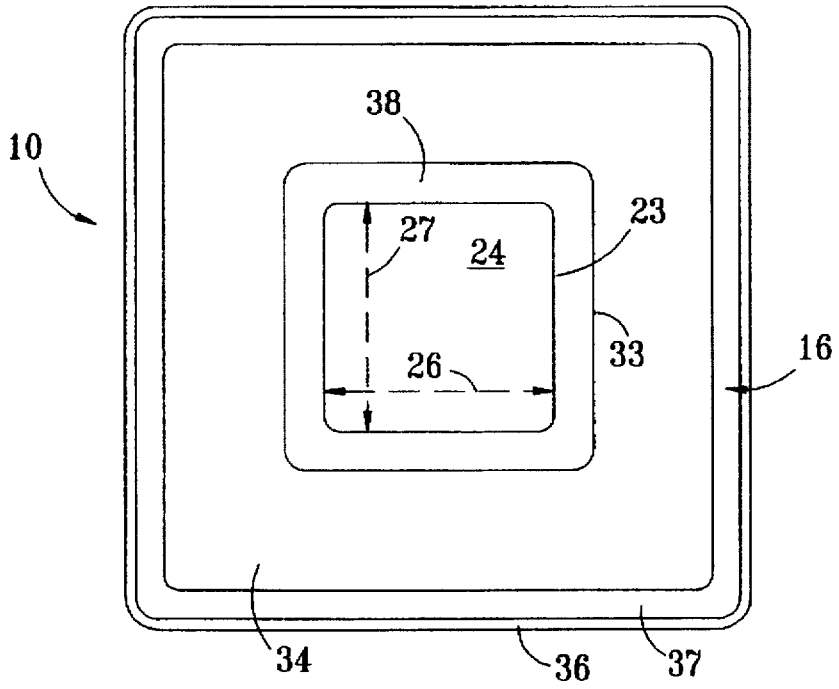
FIG. 3 is a bottom plan view of the holder apparatus of the present invention.

Referring now to FIGS. 1–3, a preferred use of holder assembly 100 will now be described. In its preferred configuration, holder 10 is designed to receive a standard size cubic tissue box 12 in inner receptacle 21 and standard craft supporting foam 14 in outer receptacle 31. In a preferred configuration, the length 27 and width 26 of inner receptacle 21 near base 24 are approximately ⅛ inch less than the length and width of the tissue box. Similarly, the top length 29 and width 28 of inner receptacle 20 are approximately ⅛ inches wider than the length and width of the tissue box. With this dimensional relationship between tissue box 12 and inner receptacle area 21, box 12 is easily inserted, retained and removed from area 21. Specifically, lower edge 13 of box 12 is secured in area 21 by the force created between side walls 22 and box 12. If later desired, box 12 is removed from area 21 by grasping box 12 at top 11 to break the force between walls 22 and bottom 13.

For example, as shown in FIG. 1, holder 10 of the present invention depicts its use with a standard size cubic tissue box having the approximate dimensions of 4½ inches width by 4¼ inches length by 5⅜ inch height. In this embodiment, holder 10 has interior base dimensions of approximately 4⅜ inches width 26 and 4⅛ inches length 27, an interior top 25 dimensions of approximately 4⅝ inches width 28 and 4⅜ inches length 29, and four interior side walls 22 approximately 5¼ inches in height.

Figure 4:
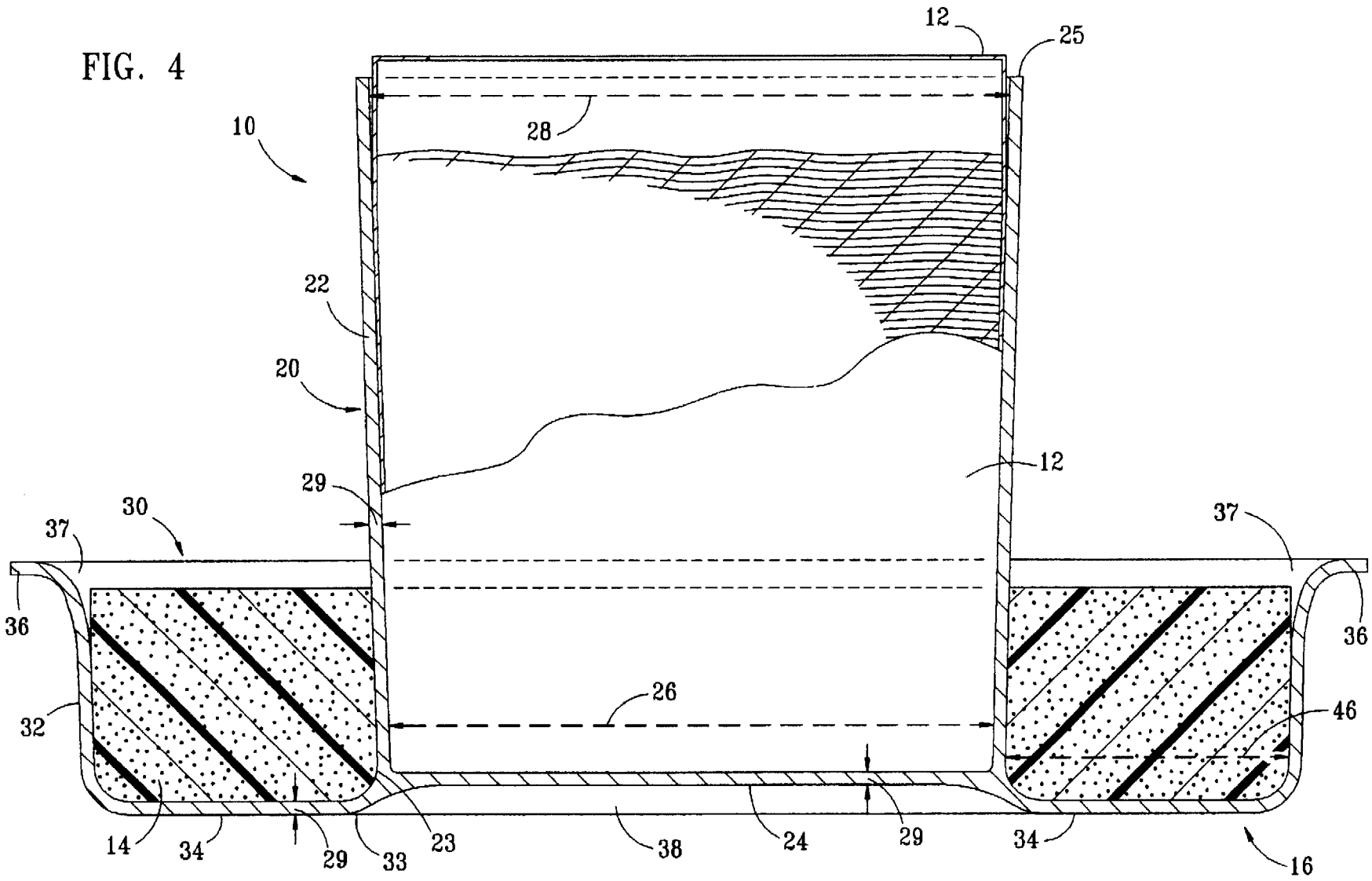
FIG. 4 is a cross-sectional view of the holder apparatus of the present invention taken along line 4—4 of FIG. 2.

Referring now to FIGS. 1 and 4, outer receptacle area 31 has side walls 32 of approximately two inches in height and an interior base width 36 of approximately 1 15/16 inches. Standard two inch width strips of craft foam 14 are manually pressed into area 31 between base 34 and side walls 22 and 32. This compression force causes foam 14 to be secured in area 31 to serve as a support for additional craft items such as artificial flowers. Optionally, the user may use live foliage, ribbons, decals, paints, or similar decorative items to change the appearance of the handcrafted holder.

Figure 5:
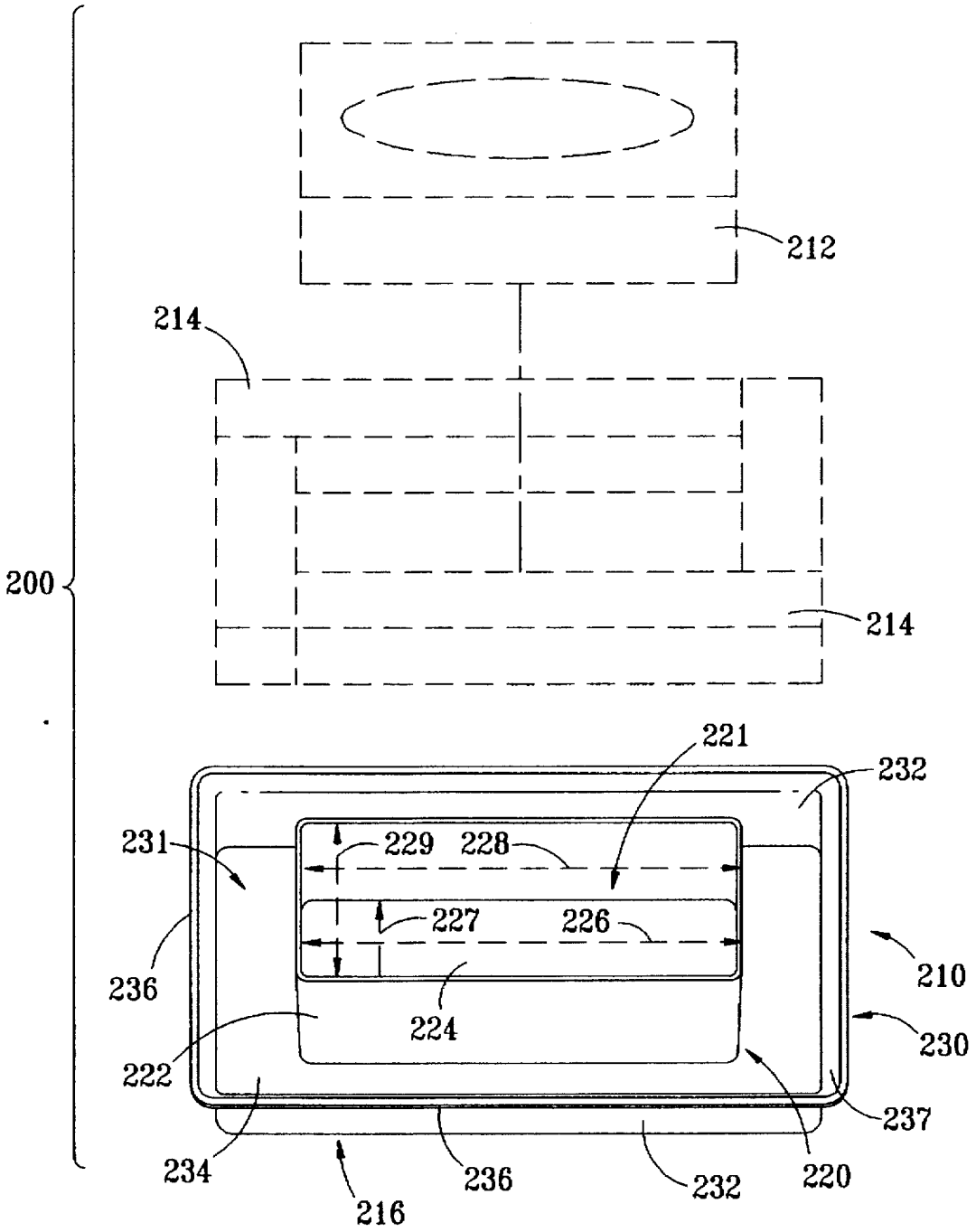
FIG. 5 is an exploded top perspective view of an alternative embodiment of the present invention with a tissue box and supporting material shown in phantom.

Referring now to FIG. 5, an alternative embodiment of the present invention is provided showing holder assembly 200 having holder 210, rectangular tissue box 210 and craft foam strips 214. Holder 210 comprises inner receptacle 220 and outer receptacle 230. Side walls 222 are substantially perpendicular to central base 224, defining inner area 221. Outer perimeter receptacle 230 has side walls 232 substantially perpendicular to base 234, flared upper edge 237 and rim 236 defining outer receptacle area 231.

As shown in FIG. 5, holder 210 of the present invention depicts its use with a standard size rectangular tissue box having the approximate dimensions of 9⅜ inches width by 4¾ inches length by 3¼ inches height. In this embodiment, holder 210 has interior base dimensions of approximately 9¼ inches width 226 and 4⅝ inches length 227, an interior top 225 dimensions of approximately 9½ inches width 228 and 4⅞ inches length 229, and four interior side walls 222 approximately 3⅛ inches in height.

As in holder assembly 100, the user of holder 210 may handcraft a personalized decorative tissue box holder assembly 200 by arranging a plurality of artificial flowers in the outer receptacle 230 and along the side walls 222 of the interior receptacle 220. Optionally, the user may include one or more segments of craft foam 214 in the outer receptacle area 231 to hold the artificial foliage in position. Once completed, the user may place the appropriate size tissue box 12 or foliage (not shown) in the interior receptacle area 221.

It is thus believed that the use and construction of the present invention will be apparent from the foregoing description. While the holder apparatus and assembly of the invention shown and described has been characterized as being preferred, it will be readily apparent that various changes and modifications could be made therein without departing from the spirit and scope of the invention as defined in the following claims.

What is claimed is:

1. A holder for retaining a removable box, comprising:

a central receptacle having a central base with a first perimeter, a central side wall, and a central cavity with a bottom length, a bottom width, a top length and a top width; and an outer receptacle having an outer base, a second perimeter, an outer side wall, and an outer cavity with an upper length, upper width, lower length and lower width, wherein said upper length and upper width are wider than said lower length and lower width, and wherein said first perimeter is adjacent to a first side of a base instep and said second perimeter is adjacent to a second side of said instep and said central base is in a horizontal plane above said outer base.

2. A holder for retaining a removable box, comprising:

a central receptacle having a central base with a first perimeter, a central side wall, and a central cavity with a bottom length, a bottom width, a top length and a top width, wherein said bottom length and bottom width are narrower than said top length and top width; and an outer receptacle having an outer base, a second perimeter, an outer side wall, and an outer cavity with a lower width; wherein said first perimeter is adjacent to a first side of a base instep and said second perimeter is adjacent to a second side of said instep and said central base is in a horizontal plane above said outer base.

3. The holder of claim 2, wherein each said central receptacle and said outer receptacle have four side walls.

4. A craft frame holder assembly for retaining a removable box and handicraft decorations, comprising:

a central receptacle having a central base with a first perimeter, a central side wall, and a central cavity with a bottom length, a bottom width, a top length and a top width;

an outer receptacle having an outer base, an second perimeter, an outer side wall, and an outer cavity with a lower width; and a supporting material positioned within said outer cavity; wherein said first perimeter is adjacent to a first side of a base instep and said second perimeter is adjacent to a second side of said instep and said central base is in a horizontal plane above said outer base.

5. The holder of claim 4, wherein said outer side wall further comprises a flared upper edge and a rim.

6. The holder of claim 4, wherein said upper length and upper width are wider than said lower length and lower width.

7. The holder of claim 6, further comprising a craft foam insert, wherein said craft foam insert is 1/16 inch wider than said lower width.

* * * * *